US006112803A

United States Patent [19]

Krüger

[11] Patent Number: 6,112,803

[45] Date of Patent: Sep. 5, 2000

[54] PROCESS FOR PRODUCING CYLINDER HEADS FOR INTERNAL COMBUSTION ENGINES

[75] Inventor: Gerd Krüger, Wetter, Germany

[73] Assignee: Bleistahl Produktions-GmbH & Co. KG, Wetter, Germany

[21] Appl. No.: 09/155,382

[22] PCT Filed: Mar. 26, 1997

[86] PCT No.: PCT/EP97/01540

§ 371 Date: Sep. 28, 1998

§ 102(e) Date: Sep. 28, 1998

[87] PCT Pub. No.: WO97/37107

PCT Pub. Date: Oct. 9, 1997

[30] Foreign Application Priority Data

Mar. 29, 1996 [DE] Germany ..... 196 12 500

[51] Int. Cl.[7] ..... B22D 19/04

[52] U.S. Cl. ..... 164/103; 164/105; 164/108

[58] Field of Search ..... 164/103, 105, 164/108

[56] References Cited

U.S. PATENT DOCUMENTS 3,167,854 2/1965 Schafer, Jr. ..... 164/108 X 3,939,897 2/1976 Kaneko et al. ..... 164/103

4,688,527 8/1987 Mott et al. .

FOREIGN PATENT DOCUMENTS 2501502 8/1948 Switzerland .

OTHER PUBLICATIONS

Abstract of Japanese Patent Publication 60–203353 Published Oct. 14, 1985.

Abstract of Japanese Patent Publication 61–115657 Published Jun. 3, 1986.

*Primary Examiner*—J. Reed Batten, Jr.

*Attorney, Agent, or Firm*—Collard & Roe, P.C.

[57] ABSTRACT

The cylinder head for internal combustion engines is produced by pouring liquid cylinder head material, especially aluminum, into a cylinder head mold containing a mold core having stepped sections in the region of the valve seat ring and the valve guide. The valve seat rings and valve guides are produced from a conventional material based on steel or copper by pressing and sintering in such a way that they have an open pore volume of 5 to 15%, a valve seat and/or a valve guide are laid on the stepped sections of the mold core, whereafter liquid aluminum is poured into the preheated mold and the mold core is removed in the conventional way after the molten aluminum has solidified.

7 Claims, 2 Drawing Sheets

PROCESS FOR PRODUCING CYLINDER HEADS FOR INTERNAL COMBUSTION ENGINES

Figure 1:
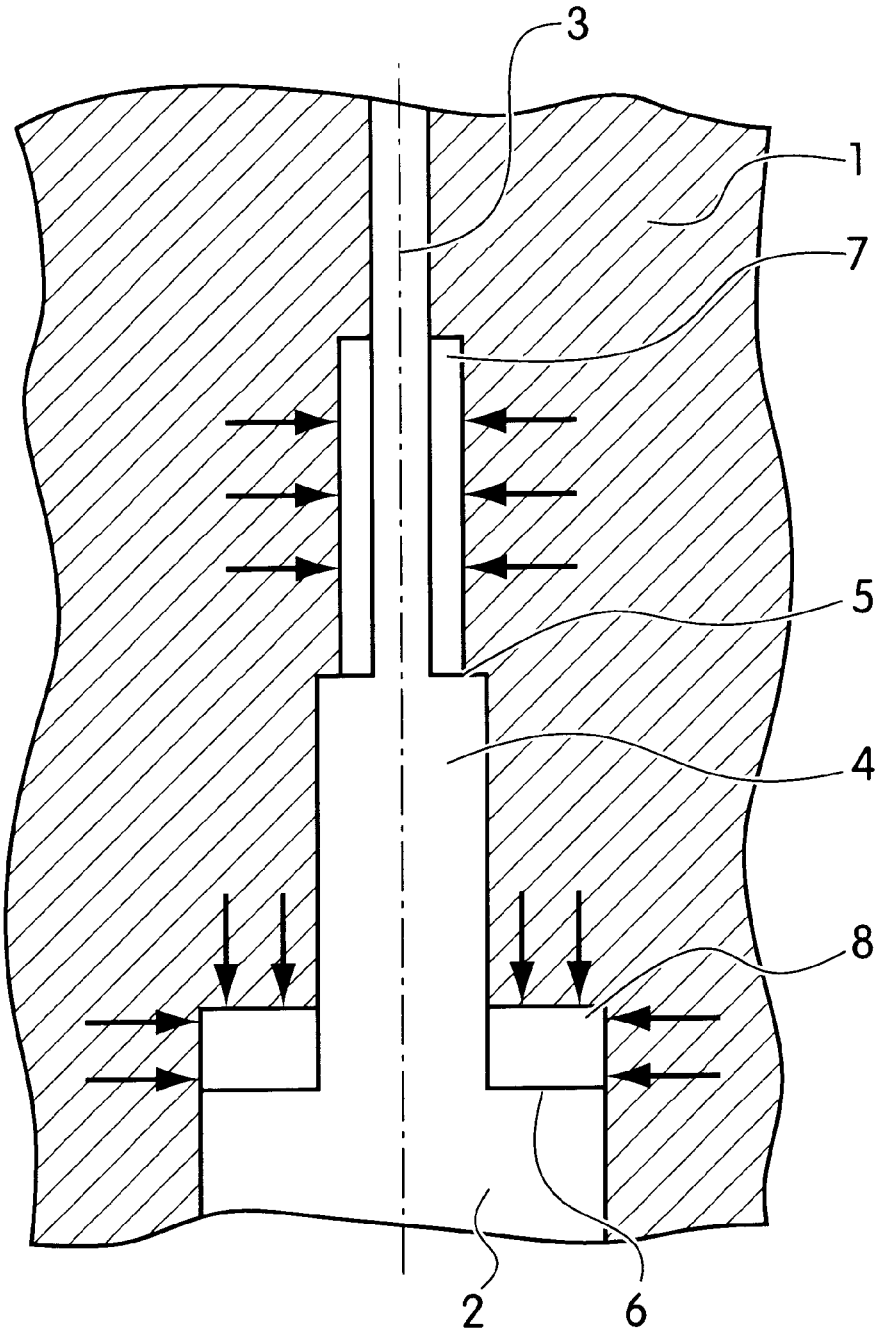

The invention relates to a process for producing cylinder heads for internal combustion engines.

In the manufacture of cylinder heads it is currently known to draw valve seat rings and valve guides with a defined operational density into corresponding bores of the cylinder head after casting of the latter from aluminum or grey cast iron has been completed. In addition, efforts are being made to treat the cylinder head material of the surface of the valve seat in order to meet the high engine stresses.

The known method of drawing in valve seat rings or hollow cylindrical valve guides requires considerable expenditure in terms of production engineering, for example machining of the valve seat ring, valve guide and cylinder head in order to maintain the required installation tolerances, and, furthermore, correct positioning before the rings or valve guides are installed in the cylinder head. In a surface treatment, for example by laser remelting or alloying, substantial amounts of energy are required which, with an efficiency of the laser of 3%, make this method appear very uneconomical.

Furthermore, efforts have been made to cast valve seat rings with high density into cylinder heads. However, no intimate bond is produced in this process between the cylinder head material and the valve seat ring (DE 39 37 402 A1). The ring is substantially retained in the cylinder head only by mechanical clamping, which produces no intimate contact with the cylinder head and thus poses the risk that the rings drop out. This solution, moreover, has the drawback of an oxidized transition from the valve seat ring to the cylinder head; the layer formed in this connection has an insulating effect and prevents high conducting heat transfer.

The objective of the invention is to eliminate said drawbacks. Accordingly, the present invention produces cylinder heads where the expenditure in terms of production engineering is reduced by directly pouring in valve seat rings and valve guides while it is nonetheless possible to obtain intimate bonding of the valve seat rings and valve guides to the cylinder head material and to thus achieve an increase in the thermal conductivity.

According to the invention the solution to said problem consists in a process for producing cylinder heads for internal combustion engines.

Valve seat rings and valve guides with an open pore volume of 5% to 15% are employed in the process as defined by the invention. In the course of the casting process for producing the cylinder head, for example by low-pressure casting, liquid aluminum penetrates the pores of the tempered valve seat rings and valve guides and fills said pores. An intimate bond between the two materials is produced in this process. If aluminum is used as cylinder head material, the thermal conductivity of the materials rises by the proportion of the infiltrated aluminum. In addition, an insulating layer is avoided within the region of the cylinder head and valve seat ring or valve guide, which increases the conduction of heat from the afore-mentioned component to the cooling circulation in the cylinder head. Cutting production steps can be dispensed with both in the working of the cylinder head and in the production of the valve seat rings and valve guides.

The invention also offers the possibility for using ceramic materials instead of the conventional seat ring and guide materials based on iron or copper, such ceramic materials being specially conceived for infiltration by liquid light metals.

Liquid aluminum can be poured into the mold either under force of gravity or under pressure, if need be with variable pressure conditions.

It is useful to heat valve seat rings and valve guide prior to pouring. This can be carried out either together with the mold after placing said components in the latter, or before placing said components in the mold.

According to an advantageous further development it is possible to adjust the pore volume of valve seat rings and valve guides in a graduated manner, i.e., in a manner such that the area with high thermal and mechanical stresses has a lower pore volume, for example of <2%, whereas areas toward the cylinder head have a pore volume within the limits specified above.

According to yet another advantageous further development different degrees of compression can be produced in the valve seat rings and/or valve guides in the course of one after-pressing operation.

Figure 2:
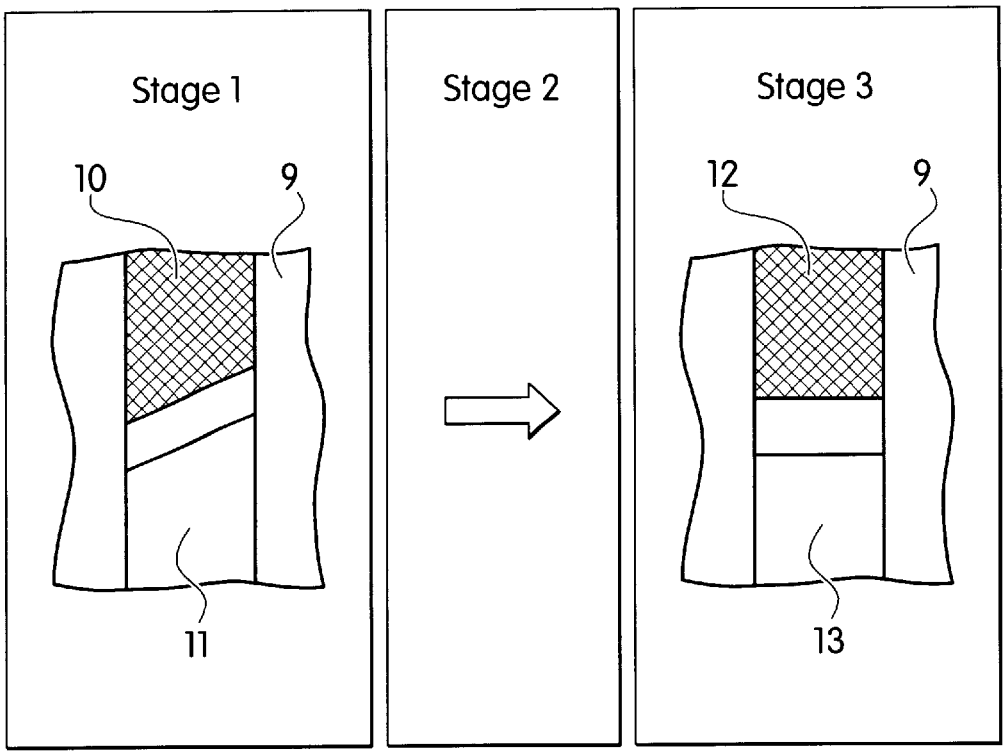

The invention is explained in greater detail in the following on an exemplified embodiment shown in the drawing, in which:

FIG. 1 is a sectional view of a cylinder head within the zone of a valve guide with a valve seat ring and valve guide, and FIG. 2 is a general sketch for producing a graduated porosity.

The drawing shows in the form of a cutout a section within the range of an inlet or outlet duct of a cylinder head after the casting operation. Mold core 2 having stepped sections has not yet been removed from the solidified aluminum melt 1. Mold core 2 contains an upper cylindrical section 3 and underneath a second cylindrical section 4 with a larger diameter. The transition between the two sections 3, 4 is formed by a plane annular shoulder 5, whereas the second section 4 adjoins at its bottom end the outer jacket surface of the cylindrical mold core 2 via an annular shoulder 6.

Prior to the pouring operation, a prefabricated valve guide 7 is placed on the upper section 3, and a prefabricated valve seat ring 8 is placed on the lower section 4. The drawing shows that the corner area between the cylindrical section 4 and the annular shoulder 6 is shaped corresponding with the contour of valve seat ring 8.

Valve seat ring 8 and valve guide 7 are produced with an open pore volume of 5% to 15% and are preheated before they are inserted. In the course of the pouring operation for casting the cylinder head, liquid aluminum penetrates the pores of tempered valve seat rings and valve guides 8, 7, filling said pores. It is important in this connection that the filled pores are evenly distributed and that the components to be cast in have adequate basic strength.

It is possible, if necessary, to adjust the pore volume of the valve drive components in a graduated way, i.e., in a manner such that the area with high thermal and mechanical stress has a pore volume of <2%, whereas the zone toward the cylinder head has a pore volume within the limit range specified in the foregoing. This can be achieved by different degrees of compression in the course of a subsequent after-pressing operation, which is explained in the following with the help of the schematic representation in FIG. 2.

A powder mixture consisting of an iron-based alloy specially composed for valve seat rings is prepressed to a density of, for example 6.4 to 6.8 g/cm$^3$ according to stage 1, using a punch 10 to obtain a body 11 with a slanted surface. In a stage 2, said blank is subsequently sintered at a temperature between 900 and 1200° C. The sintered blank is after-compressed in a stage 3 with the help of a punch 12, whereby only a geometrically predetermined zone of the ring is deformed. With pressing pressures adjusted accordingly this results in a body 13 with a density gradient from the undeformed area (density=6.4 to 6.8 g/cm$^3$) to the deformed area (density=>7.2 g/cm$^3$). The zone with the low density, i.e., the radially outer zone of a valve seat ring forms the later area of contact with the cylinder head, whereas the radially inner zone of the valve seat ring with the high density represents the later functional area.

What is claimed is:

1. A process for producing a cylinder head for an internal combustion engine using a cylinder head mold having a mold core containing upper and lower stepped sections and a valve guide and valve seat ring of iron or copper, the valve guard and seat ring being manufactured by pressing and sintering to attain an open pore volume of 5% to 15%, comprising the steps of:

placing the valve guide onto the upper stepped section;

placing the valve seat ring onto the lower stepped section of the cylinder head core;

heating the cylinder head mold;

pouring liquid cylinder head material consisting of aluminum into the cylinder head mold; and removing the mold core after the liquid cylinder head material has solidified.

2. The process according to claim 1, wherein the liquid material is poured into the mold under the force of gravity or pressure.

3. The process according to claim 1, wherein the liquid material is poured into the mold under variable pressure conditions.

4. The process according to claim 1, wherein the cylinder head mold, containing the valve guide and valve seat ring, is heated prior to pouring the liquid cylinder head material.

5. The process according to claim 1, wherein the valve guide and valve seat ring are heated before they are placed inside the cylinder head mold.

6. The process according to claim 1, wherein the valve guide and the valve seat ring are manufactured so that a pore volume of <2% is produced by varying degrees of compression in areas with high thermal and mechanical stresses.

7. The process according to claim 6, wherein the varying degrees of compression are produced in the valve guide and valve seat ring by an after-pressing operation.

* * * * *